United States Patent [19]

Castarède

[11] Patent Number: 4,541,368

[45] Date of Patent: Sep. 17, 1985

[54] PROCESS AND DEVICE FOR THE RAPID WARMUP AND THERMAL REGULATION OF THE LUBRICATING OIL OF AN INTERNAL COMBUSTION ENGINE

[75] Inventor: Armand Castarède, Meudon la Foret, France

[73] Assignee: Regie Nationale des Usines Renault, Boulogne Billancourt, France

[21] Appl. No.: 603,962

[22] Filed: Apr. 26, 1984

[51] Int. Cl.[4] ..... F01P 11/08

[52] U.S. Cl. ..... 123/41.33; 123/196 AB

[58] Field of Search ..... 123/41.33, 196 AB; 184/104 R, 104 A, 6.21, 6.22

[56] References Cited

U.S. PATENT DOCUMENTS

| | | | |
|---|---|---|---|
| 2,691,972 | 10/1954 | Stump et al. | 123/41.33 |
| 2,844,129 | 7/1958 | Beck, Jr. et al. | 123/41.33 |
| 2,913,649 | 10/1980 | Binder | 123/41.33 |
| 3,150,651 | 9/1964 | Buchner et al. | 123/41.17 |
| 3,400,694 | 9/1968 | Ernest et al. | 123/41.33 |
| 3,486,488 | 12/1969 | Frings | 123/41.33 |

FOREIGN PATENT DOCUMENTS

| | | | |
|---|---|---|---|
| 1193310 | 5/1965 | Fed. Rep. of Germany | 123/41.33 |
| 1021951 | 2/1953 | France | 123/41.33 |
| 1217937 | 5/1960 | France | 123/41.33 |

*Primary Examiner*—E. Rollins Cross

*Attorney, Agent, or Firm*—Oblon, Fisher, Spivak, McClelland & Maier

[57] ABSTRACT

Process and apparatus for the rapid warmup and thermal regulation of the lubricating oil (18) of an internal combustion engine of the type cooled by a cooling fluid (12) with a high specific heat and slight viscosity such as a water-additives mixture, circulating around the cylinders (6) or liners (8) of this engine. According to the invention, this process consists in a heat exchange between this cooling fluid (12) and lubricating oil (18) at the upper zones of these cylinders or these liners, this oil (18) being able to pick up the calories coming from the cylinder head (2) of this engine to transfer them to this cooling fluid (12).

Application: particularly to cooling and lubricating of internal combustion engines.

4 Claims, 1 Drawing Figure

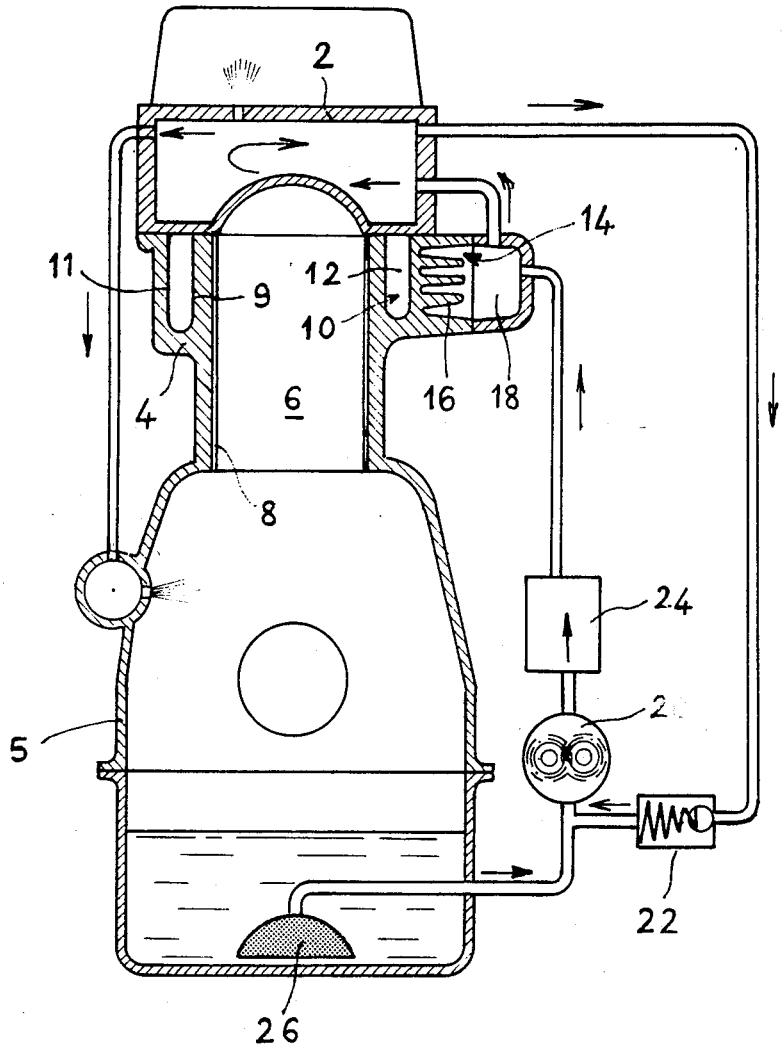
2
14
11
12
9
10
4
6
16
18
8
24
5
22
26

PROCESS AND DEVICE FOR THE RAPID WARMUP AND THERMAL REGULATION OF THE LUBRICATING OIL OF AN INTERNAL COMBUSTION ENGINE

BACKGROUND OF THE INVENTION

1. Field of the Invention

This invention relates to a process and device for rapid warmup and thermal regulation of the lubricating oil of an internal combustion engine. It applies to internal combustion engines in which cooling is provided by circulation of a fluid in conduits suitably provided in the area of the cumbustion chamber.

2. Description of the Prior Art

Numerous processes and devices have already been envisaged to limit the temperature of the cylinders or the liners in which the pistons must move with the least friction.

To cool an internal combustion engine effectively with optimal expenditure of energy, a cooling fluid, exhibiting a high specific heat and a slight viscosity, such as a water-additives mixture, usually circulates around these cylinders or these liners. This cooling fluid, put under pressure by a pump, circulates in an annular chamber whose thickness, which varies as a function of the production means such as sand molds or the molding parts of steel molds, amounts to several millimeters. This thickness given to the sheet of cooling fluid has proved excessive because only the surface layer, which is in contact with the walls of the cooling chamber of the liner or cylinder, serves to remove calories. Consequently, the flow rate of the cooling fluid, necessary for suitable heat exchanges, involves a particularly costly output.

SUMMARY OF THE INVENTION

This invention aims at using said property of the surface layers and for this purpose proposes using the so-called outside wall of the cooling chamber, opposite the liners or that forming the cylinders, to transmit or remove calories from the lubricating oil of the engine by making the best use of its calorific capacities.

This lubricating oil can also be rapidly warmed up and its temperature regulated by heat exchange with the cooling fluid of the engine.

According to a feature of the invention, the process for rapid warmup and regulation of the temperature of the lubricating oil for an internal combustion engine of the type cooled by a cooling fluid with a high specific heat and low viscosity, circulating around the cylinders or liners of this engine, consists in a heat exchange between this cooling fluid and this lubricating oil at the upper zones of these cylinders or these liners, this oil being able to take calories from the cylinder head of this engine to transfer them to this cooling fluid. The heat exchange makes it possible to dissipate the heat coming from the combustion chamber, on the one hand, and from the cylinder head, on the other, in the cooling fluid.

The lubricating oil of the engine will be used to take the calories coming from the cylinder head whose temperatures can greatly exceed those of the cylinders or liners. Consequently, a very rapid temperature rise of this oil is associated with a regulation of the temperature of this oil by heat exchange with the cooling fluid.

When the engine is started cold, the oil is rapidly warmed up and, with normal running, it gives calories to the cooling fluid. This exchange is thermally gratuitous, since it results from the flow of the cooling fluid along the wall opposite the liners or that forming the cylinders.

According to another feature of the invention, a device for using said process comprises, around the cylinders or liners, a first annular chamber in which engine cooling fluid circulates and a second annular chamber, concentric with the first, in which the engine lubricating oil circulates, this second chamber partially or totally surrounding the first so as to form a heat exchanger with it.

This arrangement promotes rapid warmup of the oil and cooling of the combustion chambers and cylinder heads. In this way, the energy expenditure caused by running the engine, mainly during the cold phases, is reduced.

Further, the rapid rise of the temperature of the lubricating oil followed by a thermal regulation of it reduces the energy expended for circulating this oil and makes it possible to use an oil with a lower viscosity.

BRIEF DESCRIPTION OF THE DRAWING

Other features and advantages of the invention will come out more clearly from the description and accompanying drawing showing an embodiment of the invention which is in no way limiting, a drawing in which:

the single FIGURE shows a diagrammatic view of an internal combustion engine showing a device for warmup and thermal regulation of the lubricating oil according to the invention, and the associated lubricating circuit.

DETAILED DESCRIPTION OF THE PREFERRED EMBODIMENT

The engine, shown in the single FIGURE, comprises a cylinder head 2, a cylinder block 4 and a housing 5. Each cylinder 6 of block 4 receives a dry liner 8 and optionally a removable wet liner. The upper region of each cylinder 6 or liner 8 is surrounded in a standard way by a first annular cooling chamber 10 in which a water-antifreeze mixture 12 circulates. This chamber exhibits outside wall 11 and inside wall 9.

According to the invention, a second annular chamber 14 with fins 16, concentric with the first 10, in which oil 18 for lubricating the engine and cooling cylinder head 2 circulates, partially surrounds first cooling chamber 10 to form a heat exchanger with it.

Essentially and in the standard way the engine lubricating circuit comprises a positive displacement vacuum pump 20, an oil pressure limiter 22, an oil filter 24 and a suction screen 26.

Functioning of the device according to the invention is described below.

Only the surface layers of water sheet 12, of slight thickness and in contact with walls 9 and 11 of cooling chamber 10, take calories coming from cylinders 6 and cylinder head 2. The middle vein of the water sheet contained in chamber 10 constitutes a thermally inert vein.

Outside wall 11 of chamber 10 can therefore transmit or remove calories from lubricating oil 18 which washes against it.

Fins 16 promote heat transfer between the two annular chambers 10 and 14. Since it is desirable to keep cylinder head 2 and the elements that are connected with it (valve seats, valves, spark plugs . . . ) at a heat level compatible with a good mechanical performance while hot, this lubricating oil 18 will be used to take the calories coming from this cylinder head 2 whose temperatures can exceed those of cylinders 6 or liners 8.

When the engine is started cold, this oil 18 will be quickly warmed up by loop circulation by means of a positive displacement vacuum pump and by heat exchange with cylinder head 2. The temperature of this oil 18 can be regulated by heat exchange through outside wall 11 of water chamber 10.

This heat exchange with cylinder head 2 makes it possible very quickly to reach the maximum temperature of engine lubricating oil 18 and thus reduce the energy expended for circulating it. The minimal oil delivery rate for cooling cylinder head 2 is a delivery rate governed by the lubricating pressure of the hot idling engine. The maximal delivery rate corresponds to that of pressure relief valve 22, used to limit the lubricating pressure to a minimal necessary value in the standard positive displacement vacuum pump 20.

The energy expended for circulating lubricating oil 18 to cool the cylinder head 2 varies essentially as a function of the pressure losses in this cylinder head; however, they are largely compensated by the fact that the rise in the oil temperature is very rapid, that the oil temperature is then regulated, which makes it possible to use an oil with a slight viscosity.

Heat exchange between cooling fluid 12 and lubricating oil 18 therefore makes it possible to reduce significantly the energy expenditure necessary to reach the optimal operating temperature of an internal combustion engine.

Actually, cooling fluid 12, while going only through water chamber 10 around cylinders 6, picks up there all the calories given off by the engine. Further, the pressure losses of the water cooling circuit are considerably reduced since this latter is no longer concerned with the cylinder head which is now cooled by the lubricating oil. The length and delivery rate of this circuit is thus divided in approximately half and the cooling radiator can be optimized as a funciton of this delivery rate and the interval in the temperature variation of the engine.

I claim:

1. A process for thermal regulation of the lubricating oil of an internal combustion engine of the type having cylinders disposed within an engine block and a cylinder head fixed on said block and being cooled by a cooling fluid having a high specific heat and a low viscosity, comprising the steps of:

circulating said cooling fluid along a path passing through a heat exchange zone of said block thermally adjacent at least the upper portions of said cylinders, said path not passing through said cylinder head;

circulating said oil along a path passing thermally adjacent said cooling fluid in said heat exchange zone and through said cylinder head; and cooling said oil during normal engine operation by heat transfer from said oil to said cooling fluid at said heat exchange zone.

2. The process of claim 1, further comprising the step of warming said oil following a cold engine start by heat transfer from said cylinder head to said oil.

3. An internal combustion engine of the type lubricated by oil and cooled by a cooling fluid comprising:

an engine block having a plurality of cylinders;

a cylinder head fixed on said block;

cooling fluid flow path means for circulating said cooling fluid along a path passing through a portion of said block but not through said cylinder head, said cooling fluid path means comprising a first chamber disposed around at least the upper portions of said cylinders; and oil flow path means for circulating said oil along a path passing thermally adjacent said first chamber and through said cylinder head, said oil flow path means comprising a second chamber at least partially surrounding said first chamber, said first and second chambers comprising means for heat exchange therebetween.

4. The engine of claim 3, further comprising fin means disposed within said second chamber for promoting heat exchange between said first and second chambers.

* * * * *